United States Patent [19]

Ambrose et al.

[11] Patent Number: 4,993,681

[45] Date of Patent: Feb. 19, 1991

[54] EASEL ASSEMBLY

[75] Inventors: Michael T. Ambrose, 8 Dunmore Terrace, Auchenflower, Queensland 4220, Australia; Steven M. Rigter, Miami, Australia

[73] Assignee: Michael T. Ambrose, Auchenflower, Australia

[21] Appl. No.: 411,361

[22] Filed: Sep. 21, 1989

[51] Int. Cl.[5] ..... A47G 1/24

[52] U.S. Cl. ..... 248/455; 248/447.1

[58] Field of Search ..... 248/447, 460, 441.1, 248/462, 465, 166, 165, 461, 455, 454, 456, 447.1; 101/126, 127.1, 128, 128.1; 269/45, 296, 303

[56] References Cited

U.S. PATENT DOCUMENTS

| | | | |
|---|---|---|---|
| 2,013,772 | 9/1935 | Ulrich | 101/126 |
| 2,332,159 | 10/1943 | McAfee | 101/126 |
| 2,811,186 | 10/1957 | Honza | 269/45 |
| 4,724,761 | 2/1988 | Bubley | 101/127.1 |
| 4,750,421 | 6/1988 | Lucas | 101/128 |
| 4,813,352 | 3/1989 | Ericsson | 101/126 |

*Primary Examiner*—Ramon O. Ramirez

*Attorney, Agent, or Firm*—Hoffman, Wasson & Gitler

[57] ABSTRACT

An easel assembly for assisting printing of artwork onto articles of clothing or textile material. The assembly has a frame, at least one support member and at least one work piece support for supporting a work piece. The support member and work piece support have complementary registry means such that the work piece support can be located and held in a desired position relative to the support member. A stencil on a carrier is included with the carrier having complementary registry means to the support member or to registry means on the frame such that the work piece support can be mounted to the support member, the carrier can be mounted to the support member and positioned overlying the work piece support to enable artwork to be applied to the work piece.

14 Claims, 4 Drawing Sheets

EASEL ASSEMBLY

The present invention relates to an easel assembly.

BACKGROUND AND SUMMARY OF THE INVENTION

In recent times it has become popular for articles of clothing such as T-shirts or textile piece goods to be impressed with artwork or the like and one technique used for imparting the artwork to the article of clothing or textile piece goods has involved the use of an air-brush technique as distinct from screen-printing. With such a technique it has been the practice for the artist to work on one article at a time and the technique consisted of placing the article on a flat surface or support and then spraying onto the article one or more patterns in sequence where each pattern of the sequence may require the artist to apply a different colour or colours with separate air-brushes. Sometimes, in this technique a stencil was employed and placed over the article during the spraying steps to ensure only desired portions of the article were worked upon in the various steps.

Where a stencil was not employed only artists of particular skill and expertise were able to consistently reproduce the same result on a series of articles. As articles of clothing and textile piece goods with artwork applied to them have become more popular it has been increasingly difficult for artists to keep pace with demand. This was because there was no ready way of producing articles of clothing or textile piece goods with air-brush artwork on any basis other than one at a time.

OBJECT

It is an object of the present invention to provide an easel assembly which at least minimises the disadvantage referred to above.

SUMMARY OF THE INVENTION

According to an aspect of the invention there is provided an easel assembly including a frame, one or more support members releasably securable to the frame, one or more work piece supports for supporting a work piece, said support member and said work piece support having complementary registry means whereby the or each said work piece support may be located in a desired orientation and position relative to the or each said support member, and at least one stencil on a carrier, the carrier having registry means complementary to the support member registry means or to registry means on the frame whereby, in use, said work piece support may be mounted to said support member, the stencil carrier may be mounted to the support member and positioned overlying said work piece support to enable artwork to be applied to the work piece.

The frame of the invention may be free standing or adapted for mounting to a wall or support. It is preferred that when the frame is adapted for mounting to a vertical wall that the frame be capable of assuming an inclined position relative to the wall whereby the frame extends outwardly and downwardly of the wall. The frame may comprise frame members forming any desired peripheral shape. In one embodiment, the peripheral shape of the frame formed by the members is substantially square or rectangular. To enable the frame to be mounted relative to a vertical wall it is preferred that mounting members be employed. In one form, two or more spaced mounting rails may be employed. These rails may be arranged extending vertically along the wall and may be adapted for releasably receiving the perimeter frame formed by the frame members. In one embodiment, the perimeter frame may have one or more hooked projections extending therefrom and these projections may co-operate with mountings provided on the wall support members. The wall support members may include one or more rails located at spaced locations therealong and the hooked projections may be selectively positioned along desired rails thereby enabling the perimeter frame to be located relative to selected rails and hence at a desired height relative to the wall.

As mentioned above, it is preferable that, when the frame is mounted to a wall, that the frame be inclined relative to the wall. To enable this to be achieved, the frame may include one or more struts extending therefrom such that when the perimeter frame is mounted to the rails of the wall support members, a free end of the or each strut may project outwardly from the rear of the perimeter frame and abut against the wall or the wall support members to thereby space a lower edge of the perimeter frame from the wall. It is preferred that the or each strut be located adjacent the lower edge of the perimeter frame although this is not essential. In one form, the or each strut has a telescopic portion which may be telescoped from the frame for a desired distance and clamped or held in that position whereby the angle formed by the frame relative to the wall may be adjusted.

The rails associated with the wall mounting members may extend between two adjacent wall mounting members. Alternatively the rails may comprise short pins extending outwardly from each wall mounting member relative to which the hooked projection of the frame may be mounted.

The frame is adapted to have one or more support member releasably mounted or secured to it. In one embodiment, frame members of the frame are provided with apertures relative to which fasteners associated with the support members may locate. Of course, the inverse of this may also be the case. Preferably, the apertures in the frame members are formed in two opposed frame members of a rectangular or square frame.

The support members may be arranged extending between two opposed or adjacent frame members of the frame. It is preferred that the support members extend between two opposed frame members. When a plurality of support members are arranged relative to the frame it is preferred that they extend across the frame and parallel to one another although they do not need to be parallel if some other orientation is desired. As mentioned above the support members have registry means whereby work piece support members may be mounted or located relative thereto and in a desired location. In one embodiment, each support member has one or more registration projection or aperture. Where a plurality of registration projections or apertures are present on each support member, those apertures or projections may extend at spaced intervals along the length of the support member. It is preferred that the spacings be regular although they need not be. Where the support members are provided with registration projections the work piece support may be formed with complementary registration recesses. Alternatively, where the support members have registration apertures, the work piece supports may have registration projections. It is preferred that the support members have registration projections and that the work piece support have complementary registration apertures. The registration projections may be in the form of outwardly projecting pins or pegs.

The work piece supports may comprise a substrate relative to which the work piece may be supported. If desired a plurality of work pieces may be supported by a single work piece support. Alternatively, a plurality of separate work piece supports may be employed and each work piece support may have one work piece located relative thereto. The work piece support may have a peripheral shape corresponding to the peripheral shape of a work piece. For example, where the work piece is an article of clothing like a T-shirt, the work piece support may be substantially rectangular in shape and having arm and neck portions relative to which the sleeves and neck portion of the T-shirt may be located. Thus, the work piece support may be positioned within the T-shirt to form a rigid substrate about which the T-shirt may locate and be held taut for the application of the artwork.

The work piece support may be made from any suitable material. For example, the work piece support may be made as a sheet from material selected from plastic, wood, metal or combinations of any two or more of these.

The registry means may be located at spaced locations on the work piece support. Where these means are registration apertures, at least two such apertures may be present in the work piece support whereby, the work piece support is located and held at two separate locations relative to a support member or a pair of support members. Preferably, at least three registration apertures are present in the work piece support and are arranged such that the work piece support may be mounted relative to three separate support members.

The stencil carrier includes stencil apertures such that when the carrier is positioned relative to the frame and overlying work piece supports, an air-brush may be used to impress an artistic design onto work pieces carried by the work piece supports. A single stencil carrier may have several sets of stencil apertures whereby each set corresponds with a particular design for an associated work piece on a work piece support. Each set may be identical or alternatively each set may differ from one another whereby a plurality of different artistic patterns may be represented on the one carrier. Alternatively, a plurality of carriers may be present and each carrier may have a plurality of stencil apertures representative of an artistic pattern to be impressed upon a work piece. Thus, where a plurality of stencil carriers are employed and mounted relative to the frame it is possible to impress artwork onto a plurality of work pieces and the artwork so impressed on each work piece may be the same or different.

Regardless of whether a single stencil carrier or a plurality of such carriers are employed, the or each carrier has registry means complementary to the registry means of the support members such that, once a first plurality of work pieces has had artwork impressed upon them, a second plurality or further number of work pieces may replace those which have had the artwork impressed upon them and may be positioned relative to the frames such that artwork may be repetitively and accurately reproduced on them. As is sometimes the case, the artwork desired may be applied to the work piece in stages. For example, one stencil carrier may be employed for a first colour and that carrier may be replaced with a further carrier or further carriers in sequence where a second or further colours are necessary to complete the artwork.

BRIEF DESCRIPTION OF THE DRAWINGS

Particular preferred embodiments will now be described with reference to the accompanying drawings in which.

FIG. *2a* is a front view of a support member;

FIG. *2b* is a side view of the member of FIG. *2a;*

Figure 1:
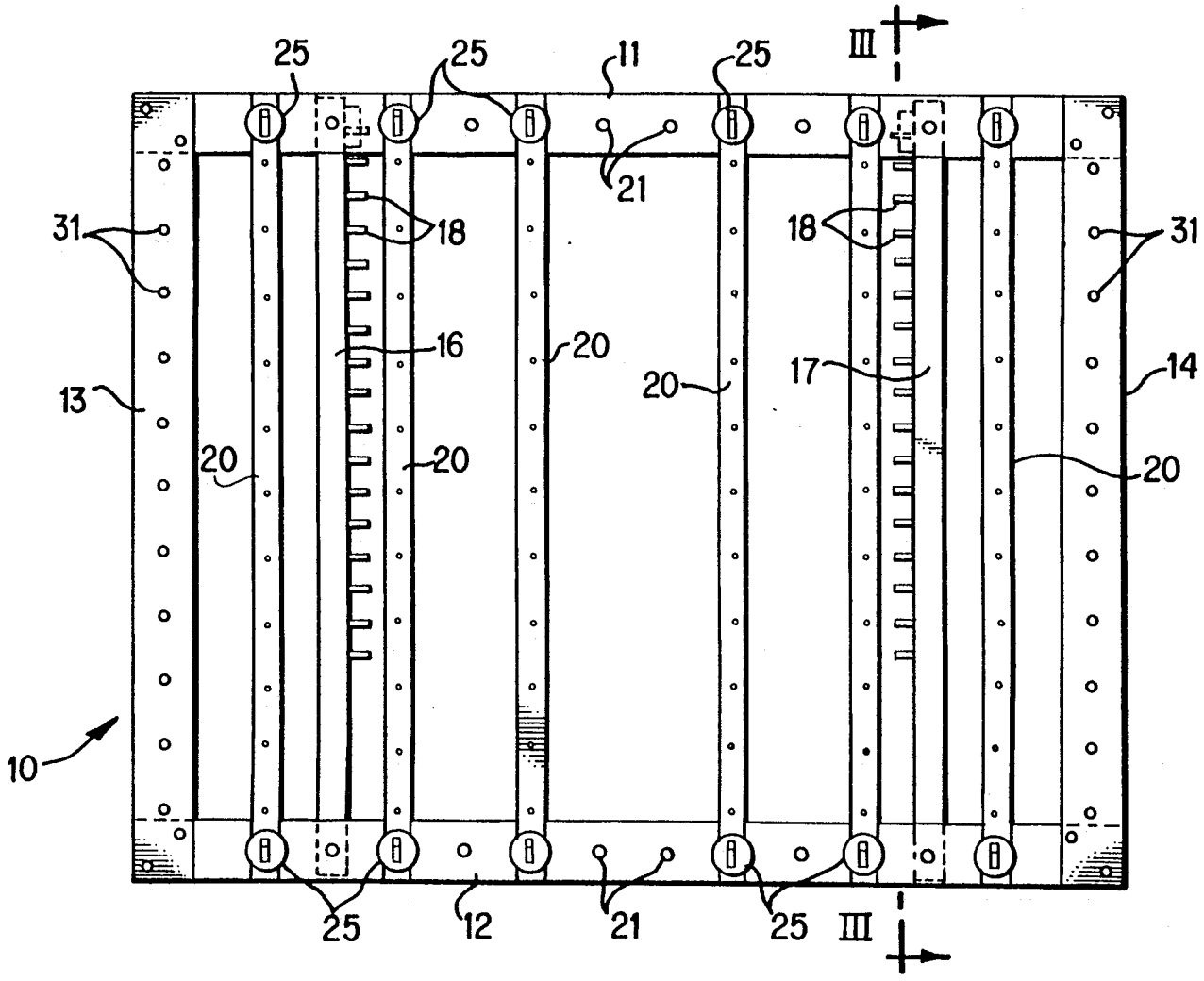
FIG. 1 is an elevational view of part of an easel assembly according to a first embodiment.
Figure 3:
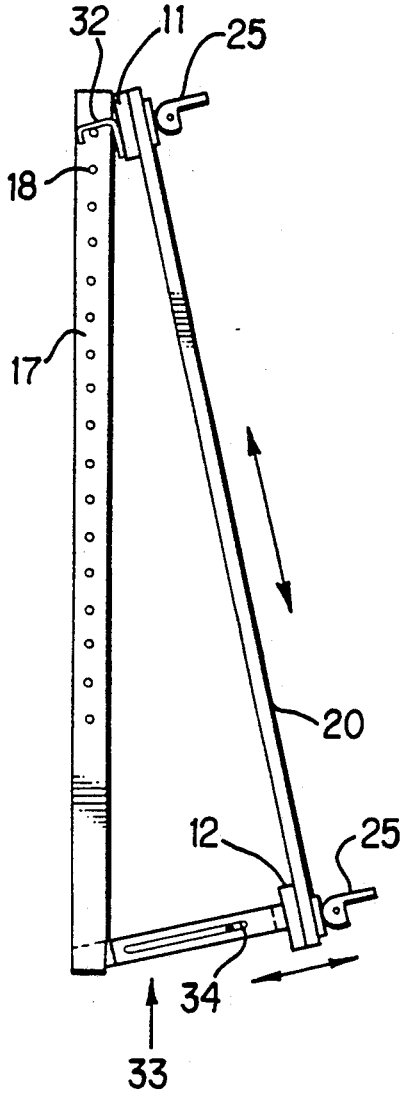
Figure 4:
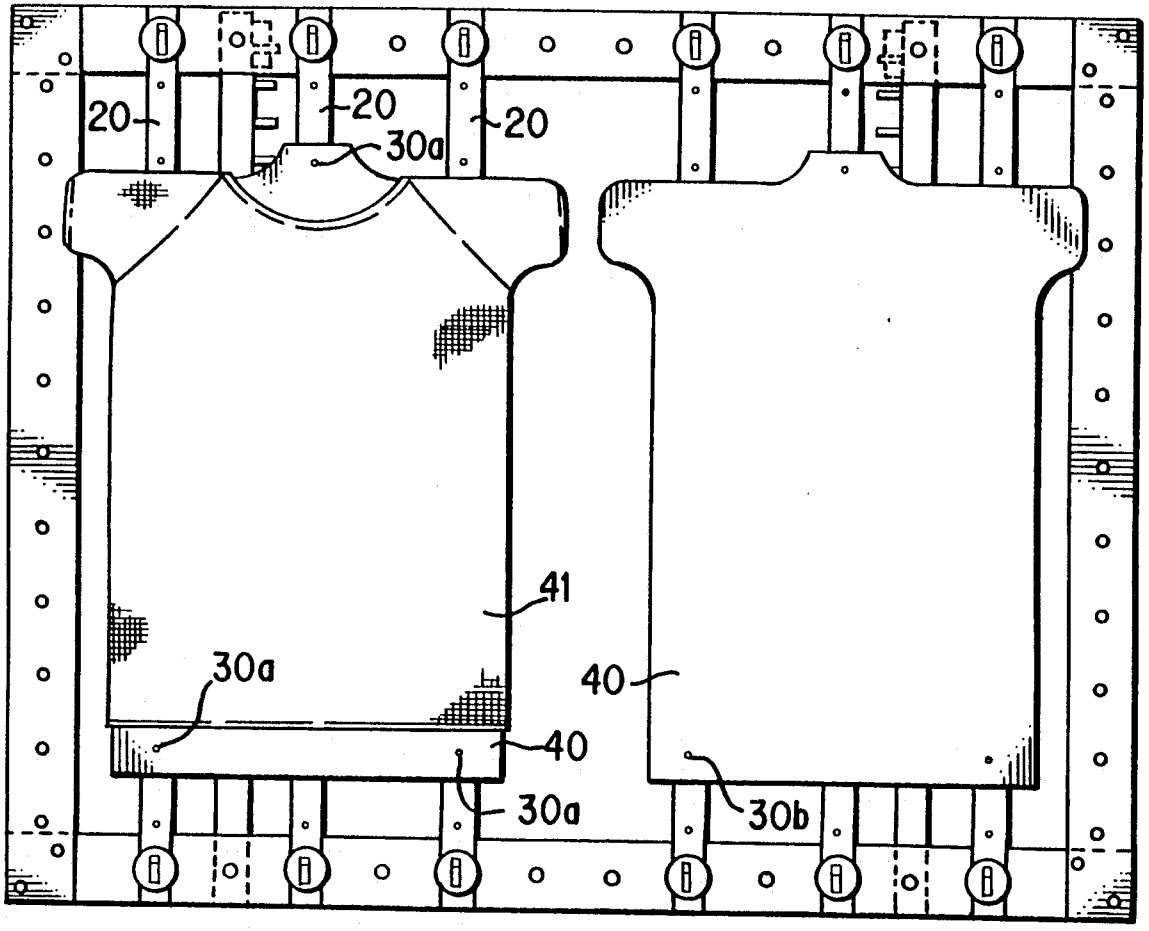
Figure 5:
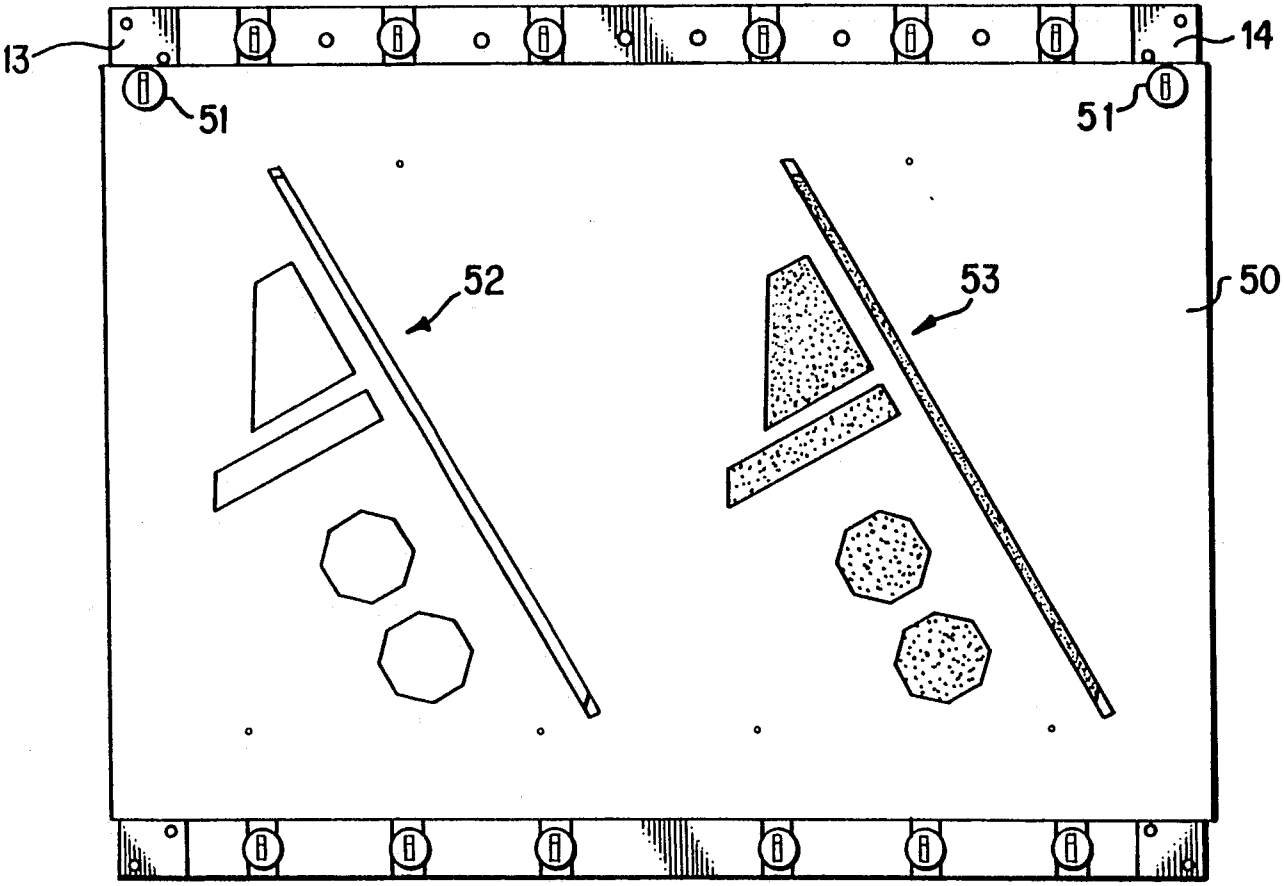

FIG. 3 is a sectional view of the part of the assembly shown in FIG. 1 taken along lines III—III;

FIG. 4 is a view like that of FIG. 1 but showing work piece supports mounted relative to the support members; and, FIG. 5 is a view of the assembly as shown in FIG. 4 but with stencil means mounted over the work piece supports and relative to the frame.

DESCRIPTION OF THE PREFERRED EMBODIMENT

With reference to FIGS. 1 and 3 there is shown part of an easel assembly 10 having a frame comprising two opposed horizontal frame members 11 and 12 and two opposed vertical frame members 13 and 14. These members together define a substantially rectangular frame. Behind the frame there is located a wall support consisting of wall support members 16 and 17. Each of these members has a series of inwardly directed projections 18 and the frame 11 may be mounted relative to a selected pair of opposed projections 18 as shown in FIG. 1. A plurality of struts 20 are arranged extending vertically between opposed frame members 11 and 12. These frame members have apertures 21 along the length thereof and it is relative to these apertures that struts 20 are releasably secured by clamping means 25 shown in greater detail in FIGS. *2a* and *2b*.

From FIGS. *2a* and *2b* further details of the support members are evident. These members carry clamping means 25 at the ends thereof. These clamping means include a camming member 26 pivotally secured to a shaft or pin 27, about which shaft a resilient sleeve 28 is secured. By rotation of camming member 26 the sleeve 28 is compressed and its diameter increases to thereby cause it to be wedged in an associated aperture 21 in the horizontal frame members 11 and 12. In this way the struts 20 may be releasably secured to the horizontal frame members 11 and 12. In the embodiment illustrated apertures 30 are arranged at intervals along the length of each strut 20. Each vertical member 13 and 14 has a plurality of apertures 31 arranged at intervals therealong.

In FIG. 3 a sectional view taken along line III—III of FIG. 1 is shown. In this figure, the frame is shown having hooked projections 32 which may locate over selected ones of pins 18 to locate the frame at a desired height relative to a wall. The frame is shown having a brace or strut member 33 comprising two members which may telescope relative to each other to enable the frame to be held at an angle relative to the wall support member 17 as shown in the figure. The telescopic members may be held relative to each other by a wing nut 34.

As is evident from FIG. 4 a plurality of work piece supports 40 may be secured to support members 20 by pins 30*a* passing through apertures 30*b* in the work piece support and locating in selected apertures 30 of the support members. In this way the work piece supports may be held relative to the frame. The left hand work piece support of FIG. 4 is shown with an article of clothing such as a T-shirt 41 mounted thereon. Thus, after article 41 has been treated the work piece support may be removed and replaced with a further one for subsequent treatment of other articles.

Figure 2B:
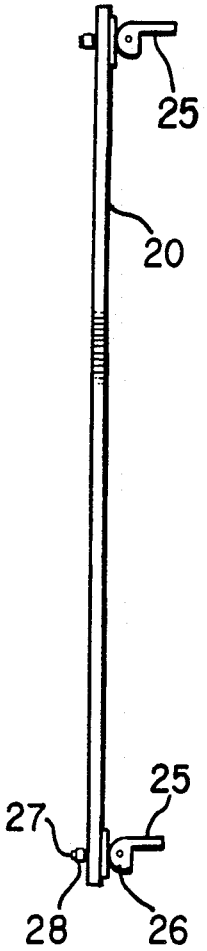
Figure 2A:
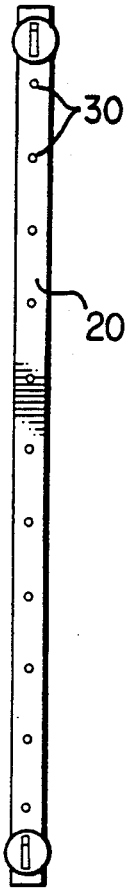

In FIG. 5, a stencil carrier 50 is releasably secured to frame members 13 and 14 by fasteners 51. Fasteners 51 are identical to those identified by the numeral 25 in FIG. 2*b* of the drawings. Stencil carrier 50 has two series of apertures 52 and 53. Each of these series of apertures is associated with a separate stencil and when the carrier 50 is secured to the frame to overlay the work piece supports 41, an air-brush or the like may then be employed to spray paint or dye through the sets of apertures to impress the desired pattern on the work pieces or articles of clothing 41. If desired, stencil carrier 50 may be removed after such an operation and replaced with a further stencil carrier to enable multiple patterns or patterns of multiple colours to be impressed upon articles 41. In this way, all articles of corresponding sizes may be impressed with a corresponding pattern and by enlarging the frame to accommodate a series of work piece supports and a corresponding number of sets of stencil apertures being provided on a stencil carrier, a number of patterned articles may easily be produced.

We claim:

1. An easel assembly including a frame having opposed frame members located in one plane, at least one wall support member releasably secured to the frame and located in a plane inclined relative to the one plane, at least one strut attached to said frame members, said strut having registry means in the form of a series of spaced apertures, at least one work piece support having complementary registry means in the form of a plurality of apertures for receiving pins whereby the work piece support can be located in a desired orientation and position over and relative to the strut, and at least one planar stencil carrier having registry apertures complementary to the apertures in the strut and in the work piece support, thereby enabling the carrier to be mounted relative thereto to overlie the work piece support to enable artwork to be applied to the work piece.

2. The assembly of claim 1 including a plurality of said work piece supports and a plurality of said struts.

3. The assembly of claim 1 wherein the registry apertures in said strut are evenly spaced along the strut.

4. The assembly of claim 3 further comprising clamping means for releasably connecting the strut to the frame.

5. The assembly of claim 4 wherein said clamping means comprises two spaced camming fasteners located at spaced locations on the strut, said frame having apertures therein, and said fasteners being engageable with said apertures.

6. The assembly of claim 1 wherein said work piece support comprises a substrate having a peripheral shape corresponding to a peripheral shape of a work piece.

7. The assembly of claim 6 including a plurality of said work piece supports.

8. The assembly of claim 1 wherein said stencil carrier has stencil apertures corresponding to a desired design.

9. The assembly of claim 8 wherein said stencil carrier has fasteners for securing the carrier to the struts.

10. The assembly of claim 8 wherein said stencil carrier has fasteners for securing the carrier to the frame, said stencil carrier also providing registry means to enable the carrier to be positioned onto the frame in a desired location.

11. The assembly of claim 10 wherein said fasteners are camming fasteners which have projections locatable relative to said registry means of said struts and said frame.

12. The assembly of claim 1 wherein said frame is substantially rectangular.

13. The assembly of claim 12 wherein said wall mounting members comprising spaced rails with inwardly directed pegs relative to which said frame members may be secured.

14. The assembly of claim 13 including an adjustable strut extending between the wall mounting members and said one pair of opposed frame members.

* * * * *